US009093019B2

(12) United States Patent
Li et al.

(10) Patent No.: US 9,093,019 B2
(45) Date of Patent: Jul. 28, 2015

(54) DRIVING SYSTEM FOR ACTIVE-MATRIX DISPLAYS

(75) Inventors: Kongning Li, Toronto (CA); Vasudha Gupta, Kitchener (CA); Gholamreza Chaji, Waterloo (CA); Arokia Nathan, Cambridge (GB)

(73) Assignee: Ignis Innovations Inc., Waterloo, Ontario (CA)

( * ) Notice: Subject to any disclaimer, the term of this patent is extended or adjusted under 35 U.S.C. 154(b) by 693 days.

(21) Appl. No.: 12/878,439

(22) Filed: Sep. 9, 2010

(65) Prior Publication Data

US 2011/0069096 A1 Mar. 24, 2011

(30) Foreign Application Priority Data

Sep. 9, 2009 (CA) ..... 2678509
Nov. 25, 2009 (CA) ..... 2686324

(51) Int. Cl.
*G09G 3/22* (2006.01)
*G09G 3/20* (2006.01)
*G09G 3/32* (2006.01)

(52) U.S. Cl.
CPC ..... *G09G 3/2081* (2013.01); *G09G 3/3225* (2013.01); *G09G 3/2022* (2013.01); *G09G 2320/0276* (2013.01); *G09G 2320/043* (2013.01); *G09G 2320/0626* (2013.01);
(Continued)

(58) Field of Classification Search
CPC ..... G09G 2320/0271; G09G 2320/0276; G09G 2320/0673
USPC ..... 345/204–215, 690–699
See application file for complete search history.

(56) References Cited

U.S. PATENT DOCUMENTS 7,688,328 B2 * 3/2010 Chen et al. ..... 345/589
2004/0145597 A1 * 7/2004 Ito ..... 345/690
2004/0239696 A1 12/2004 Okabe
(Continued)

FOREIGN PATENT DOCUMENTS

GB 2 399 935 9/2004
WO WO 2004/015668 A1 2/2004

OTHER PUBLICATIONS

Ahnood et al.: "Effect of threshold voltage instability on field effect mobility in thin film transistors deduced from constant current measurements"; dated Aug. 2009.
(Continued)

*Primary Examiner* — Kent Chang
*Assistant Examiner* — William Lu
(74) *Attorney, Agent, or Firm* — Nixon Peabody LLP

(57) ABSTRACT

A system is provided for using raw grayscale image data, representing images to be displayed in successive frames, to drive a display having pixels that include a drive transistor and an organic light emitting device. The system determines whether the raw grayscale image data for each pixel falls within a high range or a low range. Raw grayscale image data that falls within the low range is converted to higher grayscale values, and the pixels are driven with currents corresponding to the higher grayscale values during time periods that are shorter than complete frame time periods. Raw grayscale image data that falls within the high range is converted to higher grayscale values, and the pixels are driven with currents corresponding to the higher grayscale values during time periods that are shorter than complete frame time periods and different from the time periods of the low range image data.

22 Claims, 12 Drawing Sheets

(52) U.S. Cl.
CPC .. *G09G2320/0673* (2013.01); *G09G 2360/144* (2013.01); *G09G 2360/16* (2013.01)

(56) References Cited

U.S. PATENT DOCUMENTS

| | | | | |
|---|---|---|---|---|
| 2004/0252085 | A1 | 12/2004 | Miyagawa | |
| 2005/0123193 | A1* | 6/2005 | Lamberg et al. | 382/167 |
| 2005/0270262 | A1* | 12/2005 | Oh | 345/89 |
| 2006/0227082 | A1* | 10/2006 | Ogata et al. | 345/76 |
| 2006/0244391 | A1* | 11/2006 | Shishido et al. | 315/169.3 |
| 2007/0001954 | A1* | 1/2007 | Shishido et al. | 345/89 |
| 2007/0035489 | A1 | 2/2007 | Lee | |
| 2007/0164941 | A1* | 7/2007 | Park et al. | 345/77 |
| 2007/0188525 | A1* | 8/2007 | Yamanaka et al. | 345/690 |
| 2007/0242008 | A1* | 10/2007 | Cummings | 345/85 |
| 2008/0094426 | A1* | 4/2008 | Kimpe | 345/691 |
| 2008/0252665 | A1* | 10/2008 | Date | 345/690 |
| 2009/0015532 | A1* | 1/2009 | Katayama et al. | 345/89 |
| 2009/0146926 | A1* | 6/2009 | Sung et al. | 345/76 |
| 2009/0251486 | A1* | 10/2009 | Sakakibara et al. | 345/596 |
| 2010/0225634 | A1* | 9/2010 | Levey et al. | 345/212 |
| 2010/0277400 | A1* | 11/2010 | Jeong | 345/76 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Arokia Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
Jafarabadiashtiani et al.: "A New Driving Method for a-Si AMOLED Displays Based on Voltage Feedback"; dated 2005 (4 pages).
Joon-Chul Goh et al., "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
Lee et al.: "Ambipolar Thin-Film Transistors Fabricated by PECVD Nanocrystalline Silicon"; dated 2006 (6 pages).
Ma E Y et al.: "Organic light emitting diode/thin film transistor integration for foldable displays" dated Sep. 15, 1997(4 pages).
Matsueda y et al.: "35.1: 2.5-in. AMOLED with Integrated 6-bit Gamma Compensated Digital Data Driver"; dated May 2004.
Nathan A. et al., "Thin Film imaging technology on glass and plastic" ICM 2000, proceedings of the 12 international conference on microelectronics, dated Oct. 31, 2001 (4 pages).
Nathan et al.: "Backplane Requirements for Active Matrix Organic Light Emitting Diode Displays"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated 2006 (4 pages).
Philipp: "Charge transfer sensing" Sensor Review, vol. 19, No. 2, Dec. 31, 1999, 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).

(56) References Cited

OTHER PUBLICATIONS

Safavian et al.: "TFT active image sensor with current-mode readout circuit for digital x-ray fluoroscopy [5969D-82]"; dated Sep. 2005 (9 pages).
Stewart M. et al., "Polysilicon TFT technology for active matrix oled displays" IEEE transactions on electron devices, vol. 48, No. 5, dated May 2001 (7 pages).
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Chapter 3: Color Spaces Keith Jack: Video Demystified: "A Handbook for the Digital Engineer" 2001, Referex ORD-0000-00-00, USA EP040425529, ISBN: 1-878707-56-6, pp. 32-33.
Chapter 8: Alternative Flat Panel Display 1-25 Technologies; Willem den Boer: "Active Matrix Liquid Crystal Display: Fundamentals and Applications" 2005, Referex ORD-0000-00-00 U.K.; XP040426102 ISBN: 0-7506-7813-5, pp. 206-209, p. 208.
European Search Report Application EP10175764, dated Oct. 18, 2010, 2 pages.

* cited by examiner

DRIVING SYSTEM FOR ACTIVE-MATRIX DISPLAYS

CROSS-REFERENCE TO RELATED APPLICATIONS

This application claims priority to Canadian Application No. 2,678,509 which was filed Sep. 9, 2009 and Canadian Application No. 2,686,324 which was filed on Nov. 25, 2009.

FIELD OF INVENTION

The present invention relates to display technology, and particularly to driving systems for active-matrix displays such as AMOLED displays.

BACKGROUND OF THE INVENTION

A display device having a plurality of pixels (or sub-pixels) arranged in a matrix has been widely used in various applications. Such a display device includes a panel having the pixels and peripheral circuits for controlling the panels. Typically, the pixels are defined by the intersections of scan lines and data lines, and the peripheral circuits include a gate driver for scanning the scan lines and a source driver for supplying image data to the data lines. The source driver may include a gamma correction circuit for controlling the gray scale of each pixel. In order to display a frame, the source driver and the gate driver respectively provide a data signal and a scan signal to the corresponding data line and the corresponding scan line. As a result, each pixel will display a predetermined brightness and color.

In recent years, the matrix display using organic light emitting devices (OLED) has been widely employed in small electronic devices, such as handheld devices, cellular phones, personal digital assistants (PDAs), and cameras because of the generally lower power consumed by such devices. However, the quality of output in an OLED based pixel is affected by the properties of a drive transistor that is typically fabricated from amorphous or poly silicon as well as the OLED itself. In particular, threshold voltage and mobility of the transistor tend to change as the pixel ages. Moreover, the performance of the drive transistor may be effected by temperature. In order to maintain image quality, these parameters must be compensated for by adjusting the programming voltage to pixels. Compensation via changing the programming voltage is more effective when a higher level of programming voltage and therefore higher luminance is produced by the OLED based pixels. However, luminance levels are largely dictated by the level of brightness for the image data to a pixel, and the desired higher levels of luminance for more effective compensation may not be achievable while within the parameters of the image data.

SUMMARY

According to one embodiment, a system is provided for using raw grayscale image data, representing images to be displayed in successive frames, to drive a display having pixels that include a drive transistor and an organic light emitting device. The system defines high and low ranges of raw grayscale image data, and determines whether the raw grayscale image data for each pixel falls within the high range or the low range. Raw grayscale image data that falls within the low range is converted to higher grayscale values, and the pixels are driven with currents corresponding to the higher grayscale values during time periods that are shorter than complete frame time periods. When the raw grayscale image data is adjusted according to a preselected gamma curve before using that data to drive the pixels, the high and low ranges may be selected according to how well the gamma curve corrects the raw grayscale image data within the ranges. A lookup table may be used to convert the grayscale image data that falls within the low range to higher grayscale values, and the higher grayscale values may contain an indicator that they have been converted from raw grayscale image data.

In one implementation, the pixels are driven with currents corresponding to the raw grayscale image data that falls within the high range, during preselected time periods that are longer than the time periods during which the pixels are driven with currents corresponding to raw grayscale image data that falls within the low range. The preselected time periods may be shorter than a complete frame time period. Both the higher gray scale values converted from raw grayscale image data falling within the low range, and the raw grayscale image values falling within the high range, may be gamma-corrected according to the same gamma correction curve.

The system may include both a normal driving mode in which the pixels are driven with currents corresponding to the raw grayscale image data without converting any of the grayscale values to higher values, and a hybrid driving mode in which raw grayscale image data that falls within the low range is converted to higher grayscale values, and the pixels are driven with currents corresponding to said higher grayscale values during time periods that are shorter than a complete frame time period.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

DETAILED DESCRIPTION

Figure 1:
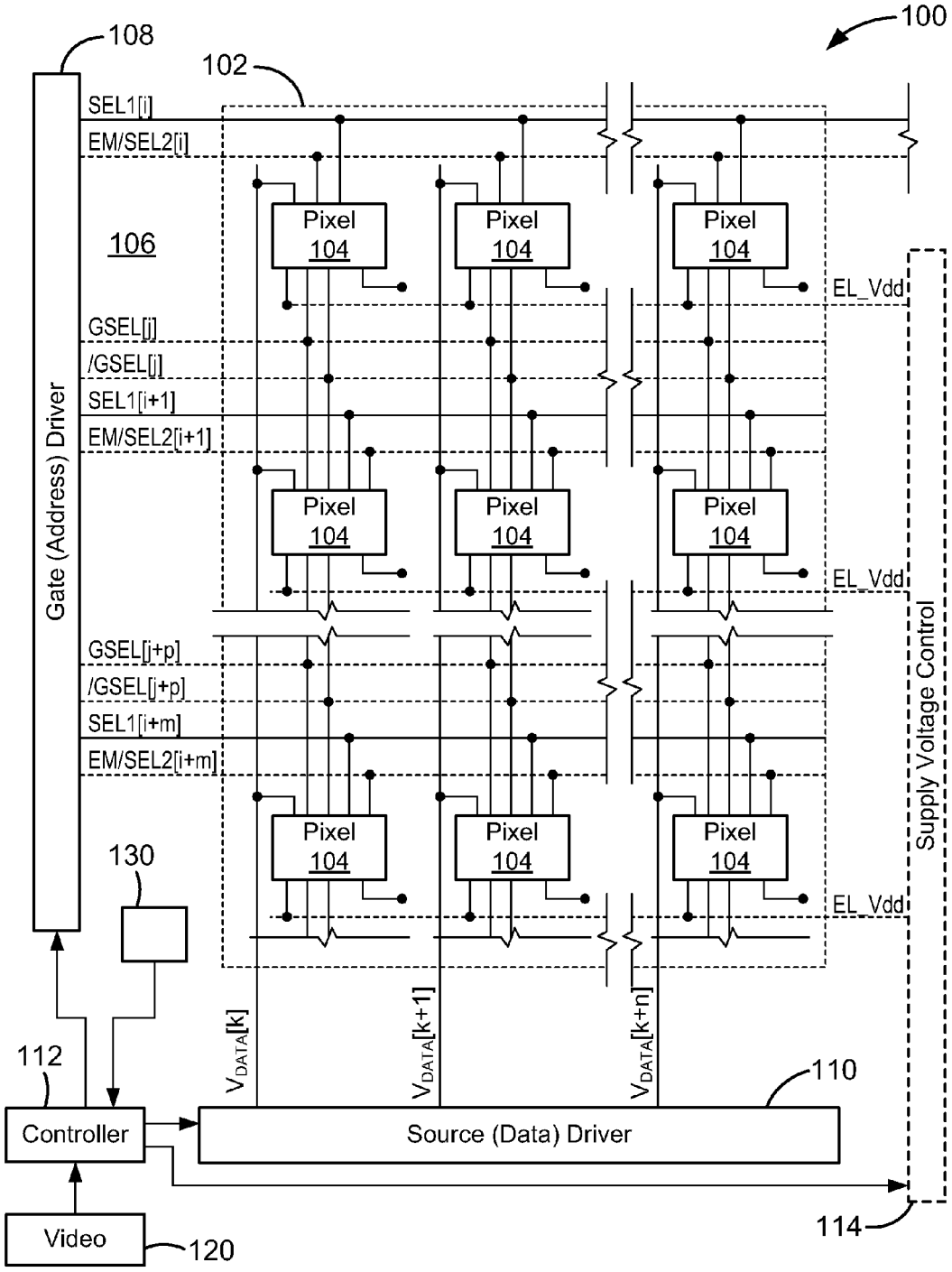
FIG. 1 is a block diagram of an AMOLED display system.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

FIG. 1 is an electronic display system 100 having an active matrix area or pixel array 102 in which an array of pixels 104 are arranged in a row and column configuration. For ease of illustration, only three rows and columns are shown. External to the active matrix area of the pixel array 102 is a peripheral area 106 where peripheral circuitry for driving and controlling the pixel array 102 are disposed. The peripheral circuitry includes a gate or address driver circuit 108, a source or data driver circuit 110, a controller 112, and a supply voltage (e.g., Vdd) driver 114. The controller 112 controls the gate, source, and supply voltage drivers 108, 110, 114. The gate driver 108, under control of the controller 112, operates on address or select lines SEL[i], SEL[i+1], and so forth, one for each row of pixels 104 in the pixel array 102. A video source 120 feeds processed video data into the controller 112 for display on the display system 100. The video source 120 represents any video output from devices using the display system 100 such as a computer, cell phone, PDA and the like. The controller 112 converts the processed video data to the appropriate voltage programming information to the pixels 104 on the display system 100.

In pixel sharing configurations described below, the gate or address driver circuit 108 can also optionally operate on global select lines GSEL[j] and optionally /GSEL[j], which operate on multiple rows of pixels 104 in the pixel array 102, such as every three rows of pixels 104. The source driver circuit 110, under control of the controller 112, operates on voltage data lines Vdata[k], Vdata[k+1], and so forth, one for each column of pixels 104 in the pixel array 102. The voltage data lines carry voltage programming information to each pixel 104 indicative of a brightness (gray level) of each light emitting device in the pixel 104. A storage element, such as a capacitor, in each pixel 104 stores the voltage programming information until an emission or driving cycle turns on the light emitting device. The supply voltage driver 114, under control of the controller 112, controls the level of voltage on a supply voltage (EL_Vdd) line, one for each row of pixels 104 in the pixel array 102. Alternatively, the voltage driver 114 may individually control the level of supply voltage for each row of pixels 104 in the pixel array 102 or each column of pixels 104 in the pixel array 102.

As is known, each pixel 104 in the display system 100 needs to be programmed with information indicating the brightness (gray level) of the organic light emitting device (OLED) in the pixel 104 for a particular frame. A frame defines the time period that includes a programming cycle or phase during which each and every pixel in the display system 100 is programmed with a programming voltage indicative of a brightness and a driving or emission cycle or phase during which each light emitting device in each pixel is turned on to emit light at a brightness commensurate with the programming voltage stored in a storage element. A frame is thus one of many still images that compose a complete moving picture displayed on the display system 100. There are at least two schemes for programming and driving the pixels: row-by-row, or frame-by-frame. In row-by-row programming, a row of pixels is programmed and then driven before the next row of pixels is programmed and driven. In frame-by-frame programming, all rows of pixels in the display system 100 are programmed first, and all of the pixels are driven row-by-row. Either scheme can employ a brief vertical blanking time at the beginning or end of each frame during which the pixels are neither programmed nor driven.

The components located outside of the pixel array 102 can be disposed in a peripheral area 106 around the pixel array 102 on the same physical substrate on which the pixel array 102 is disposed. These components include the gate driver 108, the source driver 110 and the supply voltage controller 114. Alternatively, some of the components in the peripheral area can be disposed on the same substrate as the pixel array 102 while other components are disposed on a different substrate, or all of the components in the peripheral are can be disposed on a substrate different from the substrate on which the pixel array 102 is disposed. Together, the gate driver 108, the source driver 110, and the supply voltage control 114 make up a display driver circuit. The display driver circuit in some configurations can include the gate driver 108 and the source driver 110 but not the supply voltage controller 114.

The controller 112 includes internal memory (not shown) for various look up tabales and other data for functions such as compensation for effects such as temperature, change in threshold voltage, change in mobility, etc. Unlike a convention AMOLED, the display system 100 allows the use of higher luminance of the pixels 104 during one part of the frame period while emitting not light in the other part of the frame period. The higher luminance during a limited time of the frame period results in the required brightness from the pixel for a frame but higher levels of luminance facilitate the compensation for changing parameters of the drive transistor performed by the controller 112. The system 100 also includes a light sensor 130 that is coupled to the controller 112. The light sensor 130 may be a single sensor located in proximity to the array 102 as in this example. Alternatively, the light sensor 130 may be multiple sensors such as one in each corner of the pixel array 102. Also, the light sensor 130 or multiple sensors may be embedded in the same substrate as the array 102, or have its own substrate on the array 102. As will be explained, the light sensor 130 allows adjustment of the overall brightness of the display system 100 according to ambient light conditions.

Figure 2:
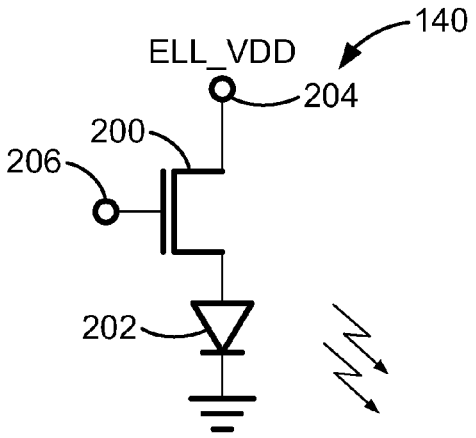
FIG. 2 is a block diagram of a pixel driver circuit for the AMOLED display in FIG. 1.

FIG. 2 is a circuit diagram of a simple individual driver circuit 200 for a pixel such as the pixel 104 in FIG. 1. As explained above, each pixel 104 in the pixel array 102 in FIG. 1 is driven by the driver circuit 200 in FIG. 2. The driver circuit 200 includes a drive transistor 202 coupled to an organic light emitting device (OLED) 204. In this example, the organic light emitting device 204 is fabricated from a luminous organic material which is activated by current flow and whose brightness is a function of the magnitude of the current. A supply voltage input 206 is coupled to the drain of the drive transistor 202. The supply voltage input 206 in conjunction with the drive transistor 202 creates current in the light emitting device 204. The current level may be controlled via a programming voltage input 208 coupled to the gate of the drive transistor 202. The programming voltage input 208 is therefore coupled to the source driver 110 in FIG. 1. In this example, the drive transistor 202 is a thin film transistor fabricated from hydrogenated amorphous silicon. Other circuit components (not shown) such as capacitors and transistors may be added to the simple driver circuit 200 to allow the pixel to operate with various enable, select and control signals such as those input by the gate driver 108 in FIG. 1. Such components are used for faster programming of the pixels, holding the programming of the pixel during different frames, and other functions.

Figure 3:
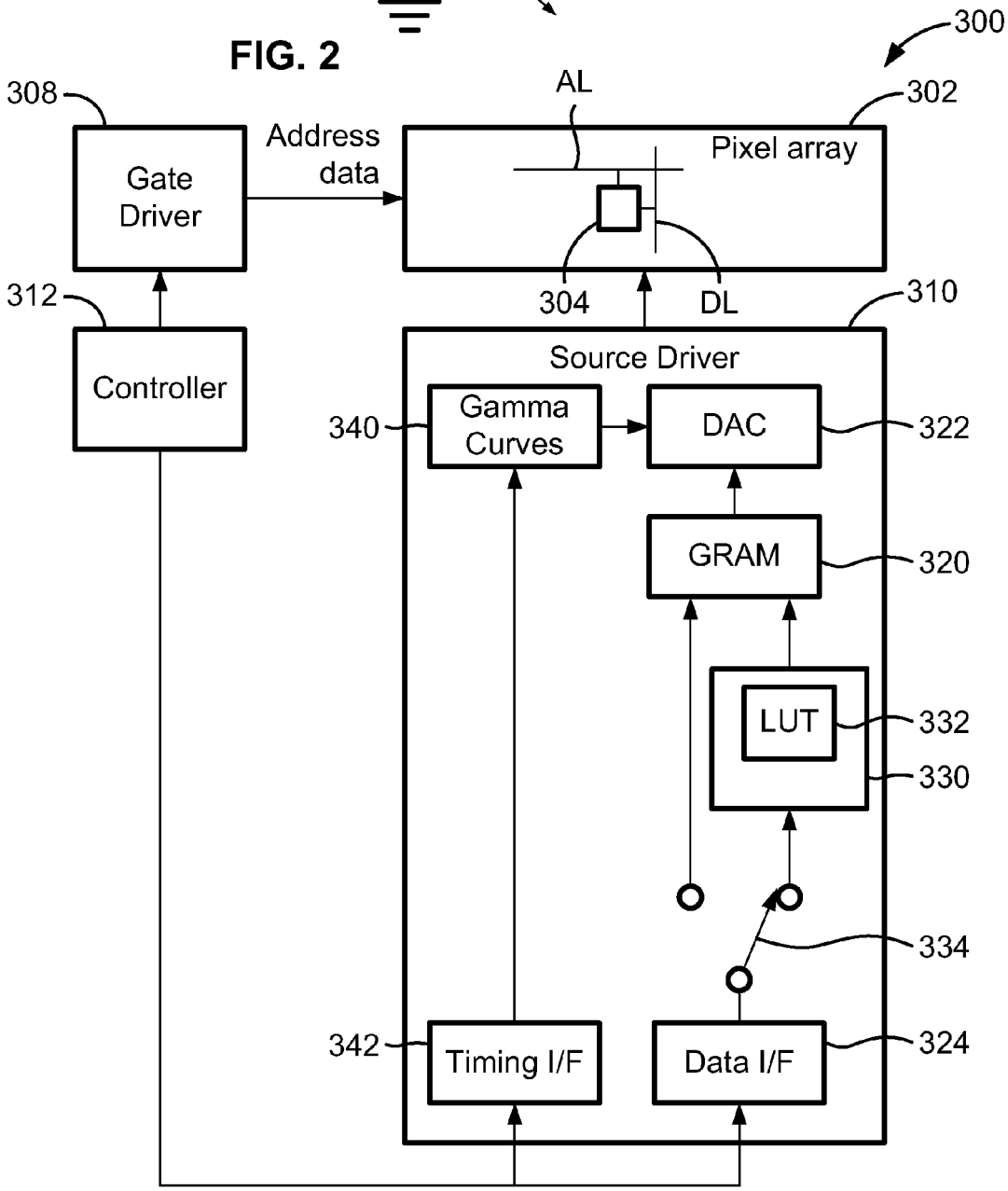
FIG. 3 is a block diagram similar to FIG. 1 but showing the source driver in more detail.
Figure 4A:
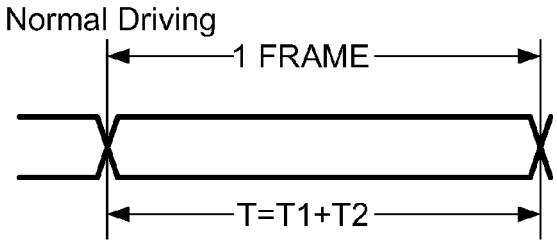
FIG. 4A-4B are timing diagrams illustrating the time period of one complete frame and two sub-frame time periods within the complete frame time period.
Figure 4B:
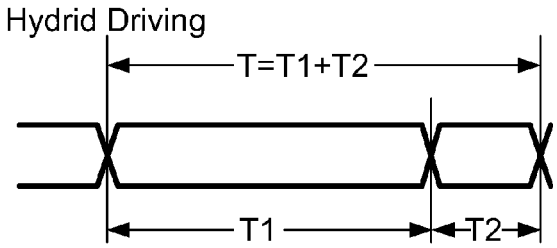
Figure 5A:
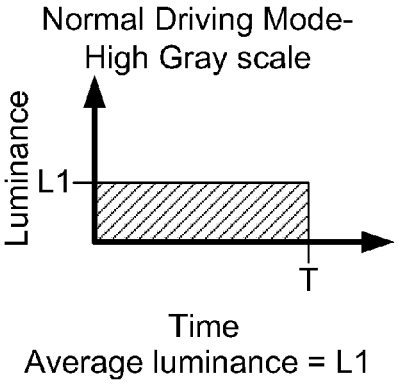
FIG. 5A-5D is a series of diagrammatic illustrations of the luminance produced by one pixel within the time periods of FIG. 4 in two different driving modes and when driven by two different grayscale values.
Figure 5C:
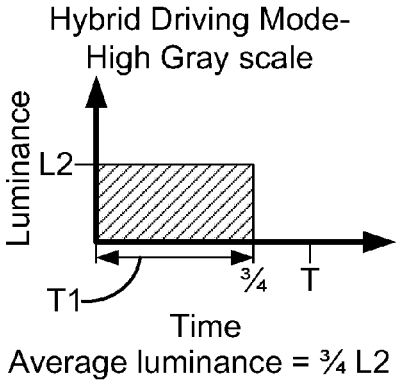
Figure 5B:
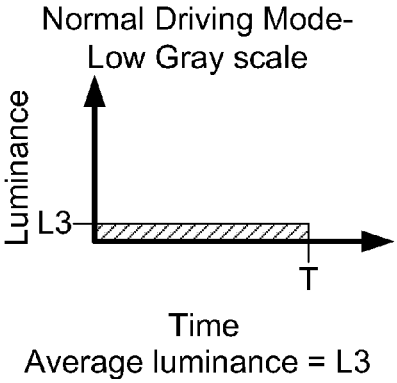
Figure 5D:
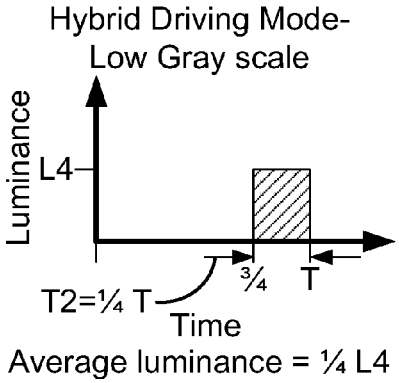

Referring to FIG. 3, there is illustrated the source driver 110 that supplies a data line voltage to a data line DL to program the selected pixels coupled to the data line DL. The controller 112 provides raw grayscale image data, at least one operation timing signal and a mode signal (hybrid or normal driving mode) to the source driver 110. Each of the gate driver 108 and the source driver 110 or a combination may be built from a one-chip semiconductor integrated circuit (IC) chip.

The source driver 110 includes a timing interface (I/F) 342, a data interface (I/F) 324, a gamma correction circuit 340, a processing circuit 330, a memory 320 and a digital-to-analog converter (DAC) 322. The memory 320 is, for example, a graphic random access memory (GRAM) for storing grayscale image data. The DAC 322 includes a decoder for converting grayscale image data read from the GRAM 320 to a voltage corresponding to the luminance at which it is desired to have the pixels emit light. The DAC 322 may be a CMOS digital-to-analog converter.

The source driver 110 receives raw grayscale image data via the data I/F 324, and a selector switch 326 determines whether the data is supplied directly to the GRAM 320, referred to as the normal mode, or to the processing circuit 330, referred to as the hybrid mode. The data supplied to the processing circuit 330 is converted from the typical 8-bit raw data to 9-bit hybrid data, e.g., by use of a hybrid Look-Up-Table (LUT) 332 stored in permanent memory which may be part of the processing circuit 330 or in a separate memory device such as ROM, EPROM, EEPROM, flash memory, etc. The extra bit indicates whether each grayscale number is located in a predetermined low grayscale range LG or a predetermined high grayscale HG.

The GRAM 320 supplies the DAC 322 with the raw 8-bit data in the normal driving mode and with the converted 9-bit data in the hybrid driving mode. The gamma correction circuit 340 supplies the DAC 322 with signals that indicate the desired gamma corrections to be executed by the DAC 322 as it converts the digital signals from the GRAM 320 to analog signals for the data lines DL. DACs that execute gamma corrections are well known in the display industry.

The operation of the source driver 110 is controlled by one or more timing signals supplied to the gamma correction circuit 340 from the controller 112 through the timing I/F 342. For example, the source driver 110 may be controlled to produce the same luminance according to the grayscale image data during an entire frame time T in the normal driving mode, and to produce different luminance levels during sub-frame time periods T1 and T2 in the hybrid driving mode to produce the same net luminance as in the normal driving mode.

In the hybrid driving mode, the processing circuit 330 converts or "maps" the raw grayscale data that is within a predetermined low grayscale range LG to a higher grayscale value so that pixels driven by data originating in either range are appropriately compensated to produce a uniform display during the frame time T. This compensation increases the luminance of pixels driven by data originating from raw grayscale image data in the low range LG, but the drive time of those pixels is reduced so that the average luminance of such pixels over the entire frame time T is at the desired level. Specifically, when the raw grayscale value is in a preselected high grayscale range HG, the pixel is driven to emit light during a major portion of the complete frame time period T, such as the portion ¾T depicted in FIG. 5(*c*). When the raw grayscale value is in the low range LG, the pixel is driven to emit light during a minor portion of the complete frame time period T, such as the portion ¼T depicted in FIG. 5(*d*), to reduce the frame time during which the increased voltage is applied.

Figure 6:
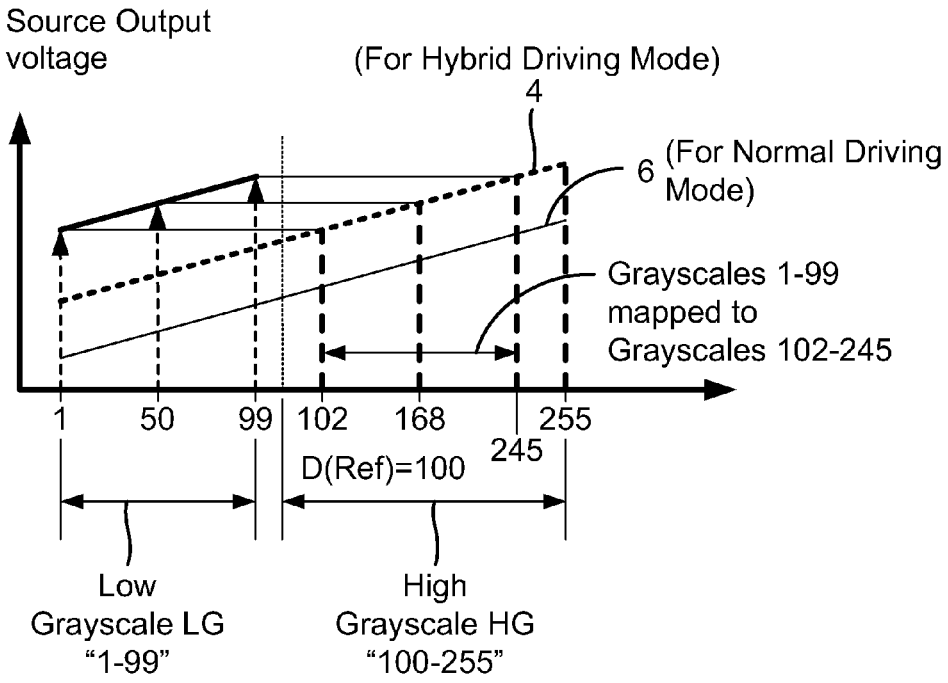
FIG. 6 is a graph illustrating two different gamma curves, for use in two different driving modes, for different grayscale values.

FIG. 6 illustrates an example in which raw grayscale values in a low range LG of 1-99 are mapped to corresponding values in a higher range of 102-245. In the hybrid driving mode, one frame is divided into two sub-frame time periods T1 and T2. The duration of one full frame is T, the duration of one sub-frame time period is T1=αT, and the duration of the other sub-frame time period is T2=(1−α)T, so T=T1+T2. In the example in FIG. 5, α=¾, and thus T1=(¾)T, and T2=(¼)T. The value of a is not limited to ¾ and may vary. As described below, raw grayscale data located in the low grayscale LG is transformed to high grayscale data for use in period T2. The operation timing of the sub-frame periods may be controlled by timing control signals supplied to the timing I/F 342. It is to be understood that more than two sub-frame time periods could be used by having different numbers of ranges of grayscales with different time periods assigned to each range.

In the example depicted in FIG. 5(*a*), L1 represents the average luminance produced during a frame period T for raw grayscale data located in the high grayscale range HG, when the normal drive mode is selected. In FIG. 5(*b*), L3 represents the average luminance produced during a frame period T for raw grayscale data located in the low grayscale range LG, in the normal drive mode. In FIG. 5(*c*), L2 represents the average luminance for raw grayscale data located in the high grayscale range HG, during the sub-frame period T1 when the hybrid drive mode is selected. In FIG. 5(*d*), L4 represents the average luminance for raw grayscale data located in the low grayscale range LG, during the sub-frame period T2 when the hybrid drive mode is selected. The average luminances produced over the entire frame period T by the sub-frame luminances depicted in FIGS. 5(*c*) and 5(*d*) are the same as those depicted in FIGS. 5 (*a*) and 5(*b*), respectively, because L2=⅘L1 and L4=4L3.

If the raw grayscale image data is located in the low grayscale range LG, the source driver 110 supplies the data line DL with a data line voltage corresponding to the black level ("0") in the sub-frame period T2. If the raw grayscale data is located in the high grayscale range HD, the source driver 110 supplies the data line DL with a data line voltage corresponding to the black level ("0") in the sub-frame period T1.

FIG. 6 illustrates the gamma corrections executed by the DAC 322 in response to the control signals supplied to the DAC 322 by the gamma correction circuit 340. The source driver 110 uses a first gamma curve 4 for gamma correction in the hybrid driving mode, and a second gamma curve 6 for gamma correction in the normal driving mode. In the hybrid driving mode, values in the low range LG are converted to higher grayscale values, and then both those converted values and the raw grayscale values that fall within the high range HG are gamma-corrected according to the same gamma curve 4. The gamma-corrected values are output from the DAC 322 to the data lines DL and used as the drive signals for the pixels 104, with the gamma-corrected high-range values driving their pixels in the first sub-frame time period T1, and the converted and gamma-corrected low-range values driving their pixels in the second sub-frame time period T2.

In the normal driving mode, all the raw grayscale values are gamma-corrected according to a second gamma curve 6. It can be seen from FIG. 6 that the gamma curve 4 used in the hybrid driving mode yields higher gamma-corrected values than the curve 6 used in the normal driving mode. The higher values produced in the hybrid driving mode compensate for the shorter driving times during the sub-frame periods T1 and T2 used in that mode.

The display system 100 divides the grayscales into a low grayscale range LG and a high grayscale range HG. Specifically, if the raw grayscale value of a pixel is greater than or equal to a reference value D(ref), that data is considered as the high grayscale range HG. If the raw grayscale value is smaller than the reference value D(ref), that data is considered as the low grayscale range LG.

Figure 7:
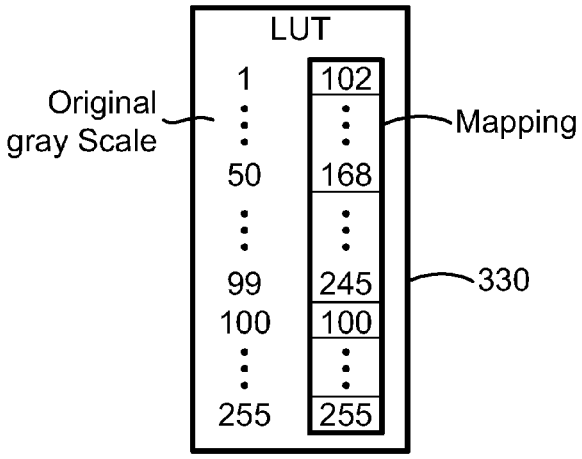
FIG. 7 is an illustration of exemplary values used to map grayscale data falling within a preselected low range to higher grayscale values.

In the example illustrated in FIG. 6, the reference value D(ref) is set to 100. The grayscale transformation is implemented by using the hybrid LUT 132 of FIG. 1, as illustrated in FIGS. 6 and 7. One example of the hybrid LUT 132 is shown in FIG. 7 where the grayscale values 1-99 in the low grayscale range LG are mapped to the grayscale values 102-245 in the high grayscale range HG.

Assuming that raw grayscale data from the controller 112 is 8-bit data, 8-bit grayscale data is provided for each color (e.g., R, G, B etc) and is used to drive the sub-pixels having those colors. The GRAM 320 stores the data in 9-bit words for the 8-bit grayscale data plus the extra bit added to indicate whether the 8-bit value is in the low or high grayscale range.

Figure 9:
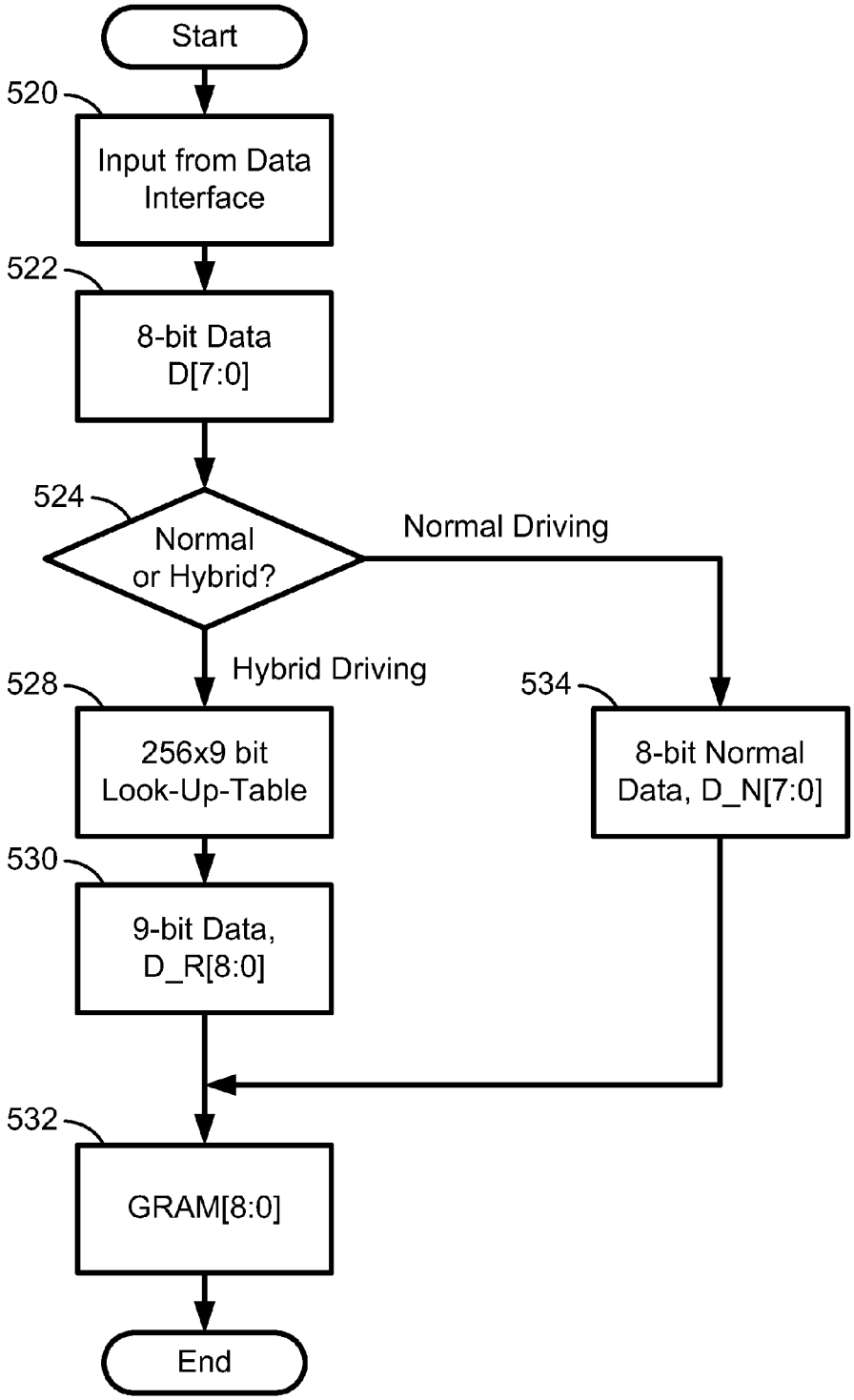
FIG. 9 is a flow chart of a process executed by the source driver to convert raw grayscale image data that falls within a low range, to higher grayscale values.

In the flow chart of FIG. 9, data in the GRAM 320 is depicted as the nine bit word GRAM[8:0], with the bit GRAM[8] indicating whether the grayscale data is located in the high grayscale range HG or the low grayscale range LG. In the hybrid driving mode, all the input data from the data I/F 124 is divided into two kinds of 8-bit grayscale data, as follows:

1. If the raw input data is in the 8 bits of high grayscale range, local data D[8] is set to be "1" (D[8]=1), and the 8 bits of the local data D[7:0] is the raw grayscale data. The local data D[8:0] is saved as GRAM[8:0] in GRAM 320 where GRAM[8]=1.

2. If the raw input data is in the low grayscale LG, local data D[8] is set to be "0" (D[8]=0), and local data D[7:0] is obtained from the hybrid LUT 332. The local data D[8:0] is saved as GRAM[8:0] in GRAM 320

FIG. 9 is a flow chart of one example of an operation for storing 8-bit grayscale data into the GRAM 320 as a 9-bit GRAM data word. The operation is implemented in the processing circuit 330 in the source driver 110. Raw grayscale data is input from the data I/F 124 at step 520, providing 8-bit data at step 522. The processing circuit 330 determines the system mode, i.e., normal driving mode or hybrid driving mode, at step 524. If the system mode is the hybrid driving mode, the system uses the 256*9 bit LUT 132 at step 528 to provide 9-bit data D_R[8:0] at step 530, including the one-bit range indicator. This data is stored in the GRAM 320 at step 532. If the system mode is the normal driving mode, the system uses the raw 8-bit input data D_N[7:0] at step 534, and stores the data in the GRAM 320 at step 532.

Figure 8:
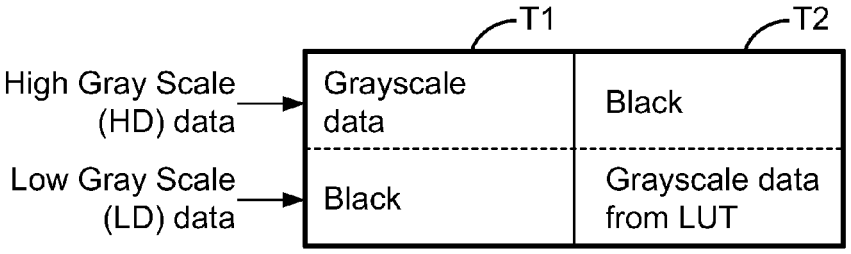
FIG. 8 is a diagrammatic illustration of the data used to drive any given pixel in the two sub-frame time periods illustrated in FIG. 4, when the raw grayscale image data is in either of two different ranges.
Figure 10:
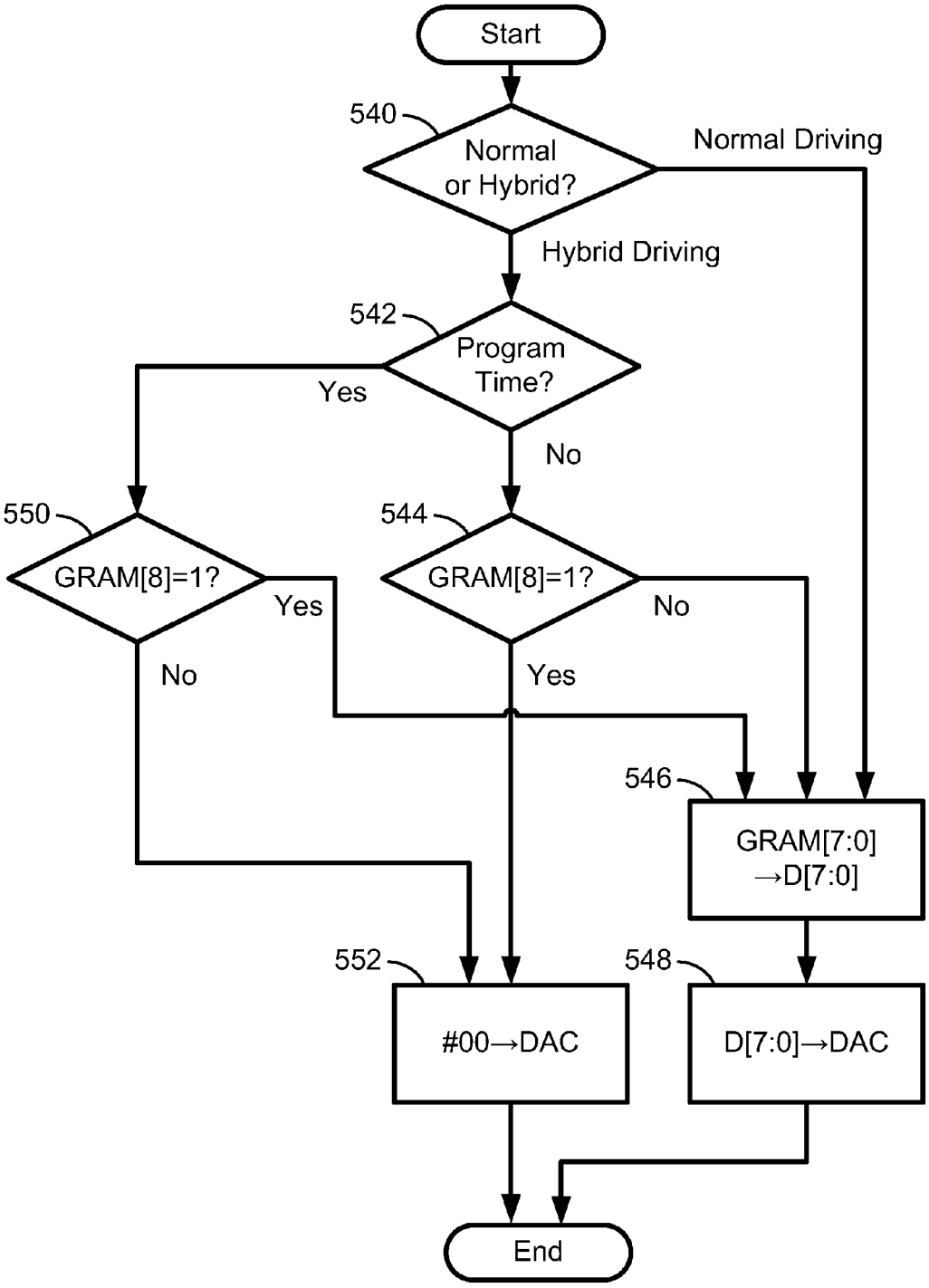
FIG. 10 is a flow chart of a process executed by the source driver to supply drive data to the pixels in either of two different operating modes.

FIG. 10 is a flow chart of one example of an operation for reading 9-bit GRAM data words and providing that data to the DAC 322. The system (e.g., the processing circuit 330) determines whether the current system mode is the normal driving mode or the hybrid driving mode at step 540. If the current mode is the hybrid driving mode, the system determines whether it is currently in a programming time at step 542. If the answer at step 542 is negative, step 544 determines whether GRAM [8]=1, which indicates the raw grayscale value was in the low range LG. If the answer at step at step 544 is negative, indicating that the raw grayscale value is in the high range HG, GRAM [7:0] is provided as local data D[7:0] and the values of the appropriate LUT 132 are used at step 546 to provide the data D [7:0] to the DAC 322 at step 548. If the answer at step 544 is affirmative, Black (VSL) ("#00") is provided to the DAC 322 at step 552, so that black level voltage is output from the DAC 122 (see FIG. 8).

In the programming period, step 550 determines whether GRAM [8]=1. If the answer at step 550 is affirmative indicating the raw grayscale value is in the high range HG, the system advances to steps 546 and 548. If the answer at step 550 is negative indicating the raw grayscale value is in the low range LG, the system advances to step 552 to output a black-level voltage (see FIG. 8).

Figure 11:
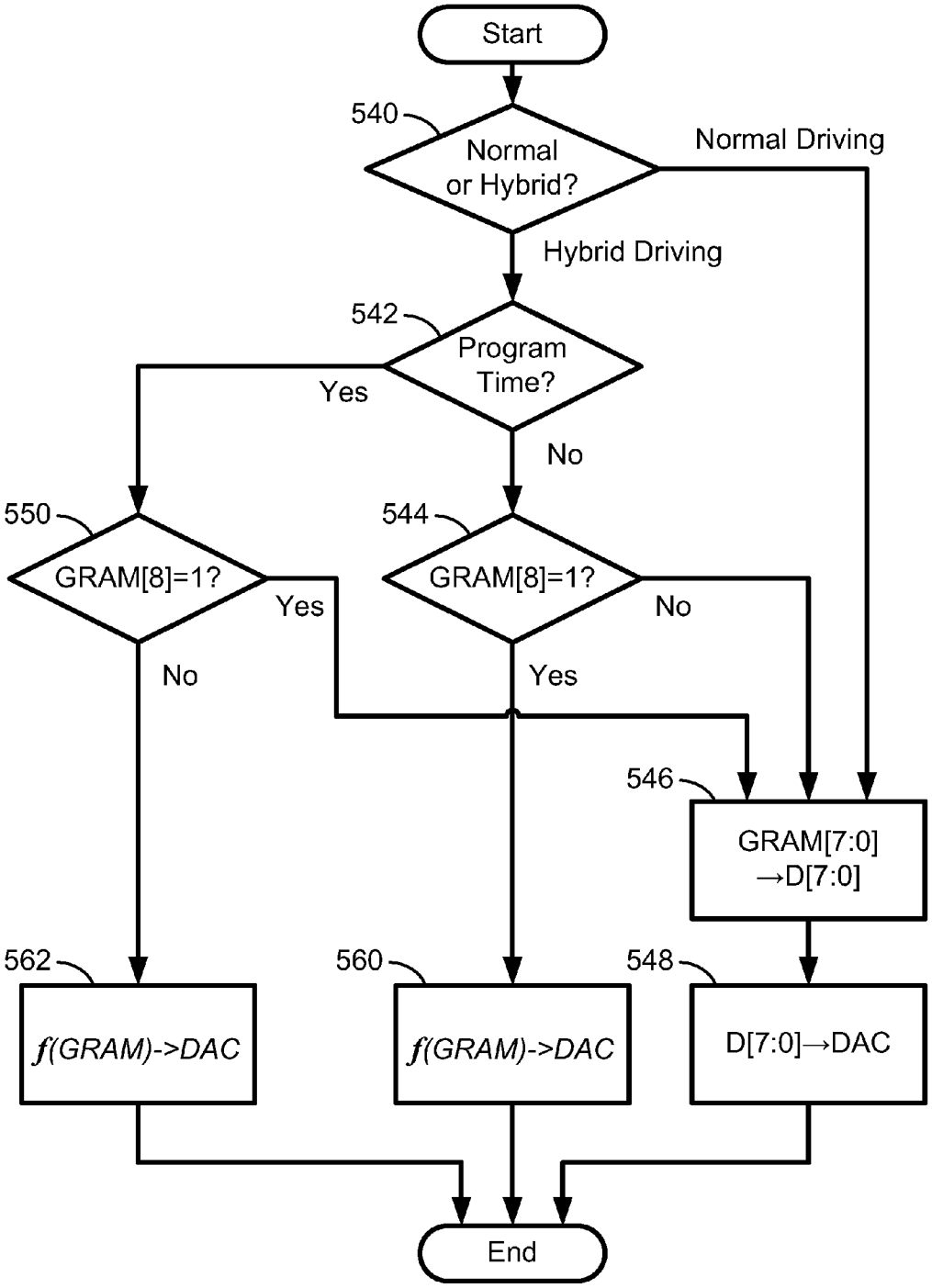
FIG. 11 is a flow chart of the same process illustrated in FIG. 10 with the addition of smoothing functions.

FIG. 11 is a flow chart of another example of an operation for reading 9-bit GRAM data and providing that data to the DAC 322. To avoid contorting effects during the transaction, the routine of FIG. 11 uses a smoothing function for a different part of a frame. The smoothing function can be, but is not limited to, offset, shift or partial inversion. In FIG. 11, the step 552 of FIG. 10 is replaced with steps 560 and 562. When the system is not in a programming period, if GRAM[8]=1 (high range HG grayscale value), GRAM [7:0] is processed by the smoothing function $f$ and then provided to the DAC 322 at step 560. In the programming period, if GRAM[8]≠1 (low range LG grayscale value), GRAM [7:0] is processed by the smoothing function f and then provided to the DAC 322 at step 562.

Figure 12:
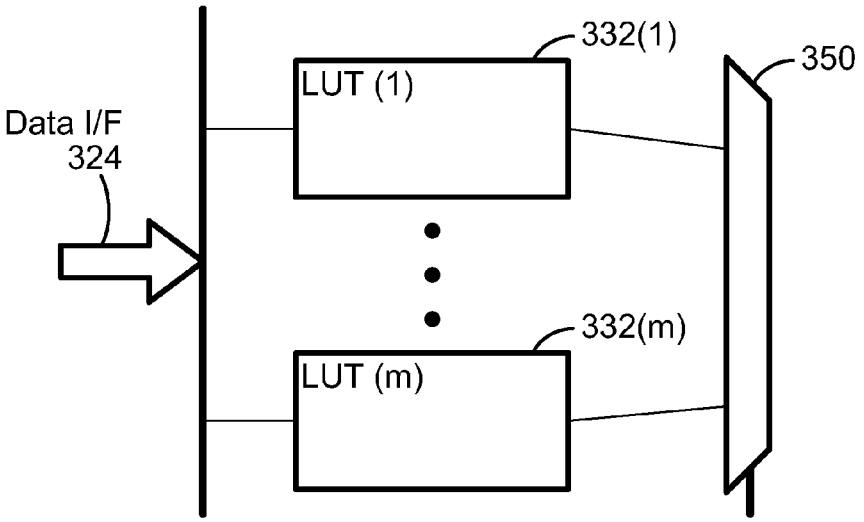
FIG. 12 is a diagram illustrating the use of multiple lookup tables in the processing circuit in the source driver.

Although only one hybrid LUT 332 is illustrated in FIG. 3, more than one hybrid LUT may be used, as illustrated in FIG. 12. In FIG. 12, a plurality of hybrid LUTs 332 (1) . . . 332 (*m*) receive data from, and have outputs coupled to, a multiplexer 350. Different ranges of grayscale values can be converted in different hybrid LUTs.

Figure 13:
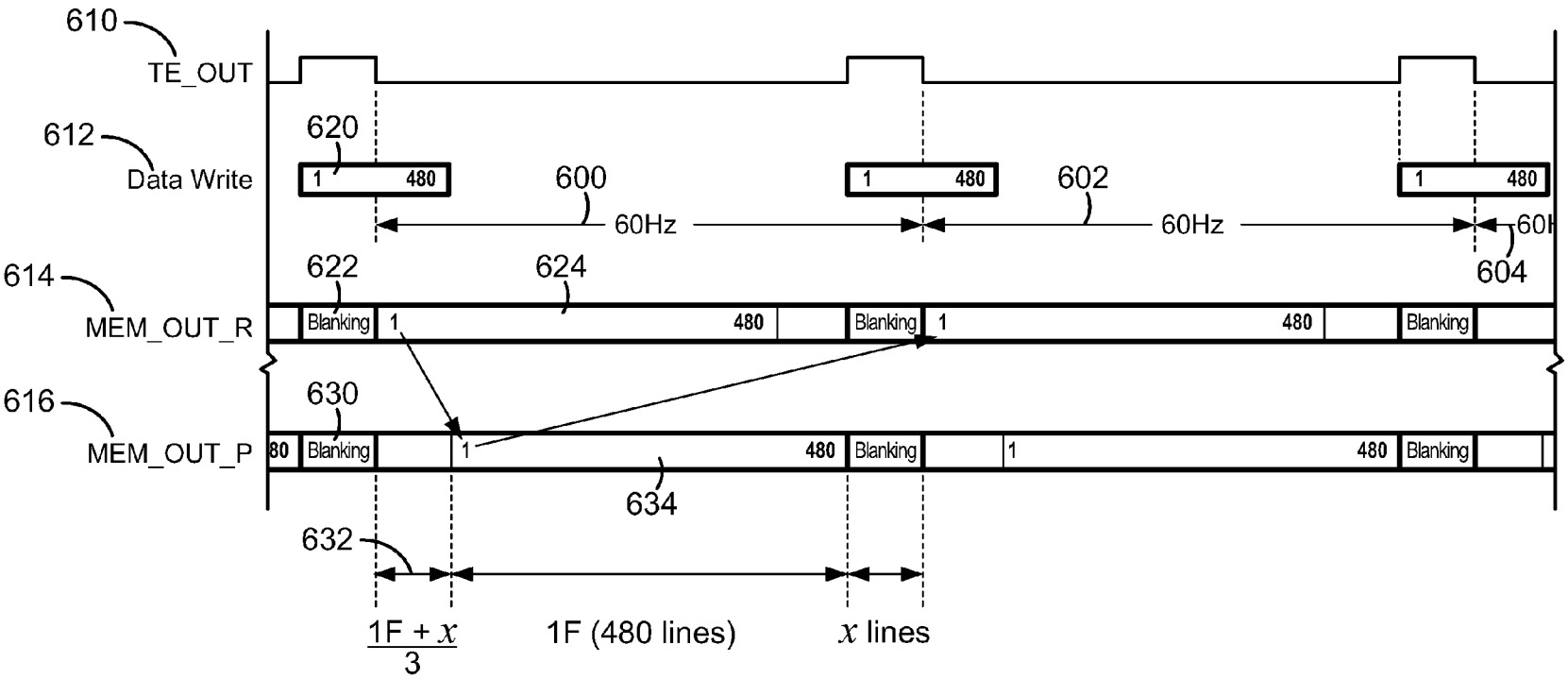
FIG. 13 is a timing diagram of the programming signals sent to each row during a frame interval in the hybrid driving mode of the AMOLED display in FIG. 1.

FIG. 13 is a timing diagram of the programming signals sent to each row during a frame interval in the hybrid driving mode of the AMOLED display in FIG. 1 and FIG. 3. Each frame is assigned a time interval such as the time intervals 600, 602, and 604, which is sufficient to program each row in the display. In this example, the display has 480 rows. Each of the 480 rows include pixels for corresponding image data that may be in the low grayscale value range or the high grayscale value range. In this example, each of the time intervals 600, 602, and 604 represent 60 frames per second or a frequency of 60 Hz. Of course other higher and lower frequencies and different numbers of rows may be used with the hybrid driving mode.

The timing diagram in FIG. 13 includes control signals necessary to avoid a tearing effect where programming data for the high and low grayscale values may overlap. The control signals include a tearing signal line 610, a data write signal line 612, a memory out low value (R) signal line 614 and a memory out high value (P) signal line 616. The hybrid driving mode is initiated for each frame by enabling the tearing signal line 610. The data write signal line 612 receives the row programming data 620 for each of the rows in the display system 100. The programming data 620 is processed using the LUTs as described above to convert the data to analog values reflecting higher luminance values for shortened intervals for each of the pixels in each row. During this time, a blanking interval 622 and a blanking interval 630 represent no output through the memory write lines 614 and 616 respectively.

Once the tearing signal line 610 is set low, a row programming data block 624 is output from the memory out low value line 614. The row programming data block 624 includes programming data for all pixels in each row in succession beginning with row 1. The row programming data block 624 includes only data for the pixels in the selected row that are to be driven at values in the low grayscale range. As explained above, all pixels that are to be driven at values in the high grayscale range in a selected row are set to zero voltage or adjusted for distortions. Thus, as each row is strobed, the DAC 322 converts the low gray scale range data (for pixels programmed in the low grayscale range) and sends the programming signals to the pixels (LUT modified data for the low grayscale range pixels and a zero voltage or distortion adjustment for the high grayscale range pixels) in that row.

While the row programming data block 624 is output, the memory output high value signal line 616 remains inactive for a delay period 632. After the delay period 632, a row programming data block 634 is output from the memory out high value line 616. The row programming data block 634 includes programming data for all pixels in each row in succession beginning with row 1. The row programming data block 634 includes only data for the pixels that are to be driven at values in the high grayscale range in the selected row. As explained above, all pixels that are to be driven at values in the low grayscale range in the selected row are set to zero voltage. The DAC 322 converts the high gray scale range data (for pixels programmed in the high grayscale range) and sends the programming signals to the pixels (LUT modified data for the high grayscale range pixels and a zero voltage for the low grayscale range pixels) in that row.

In this example, the delay period 632 is set to 1F+x/3 where F is the time it takes to program all 480 rows and x is the time of the blanking intervals 622 and 630. The x variable may be defined by the manufacturer based on the speed of the components such as the processing circuit 330 necessary to eliminate tearing. Therefore, x may be lower for faster processing components. The delay period 632 between programming pixels emitting a level in the low grayscale range and those pixels emitting a level in the high grayscale range avoids the tearing effect.

Figure 14A:
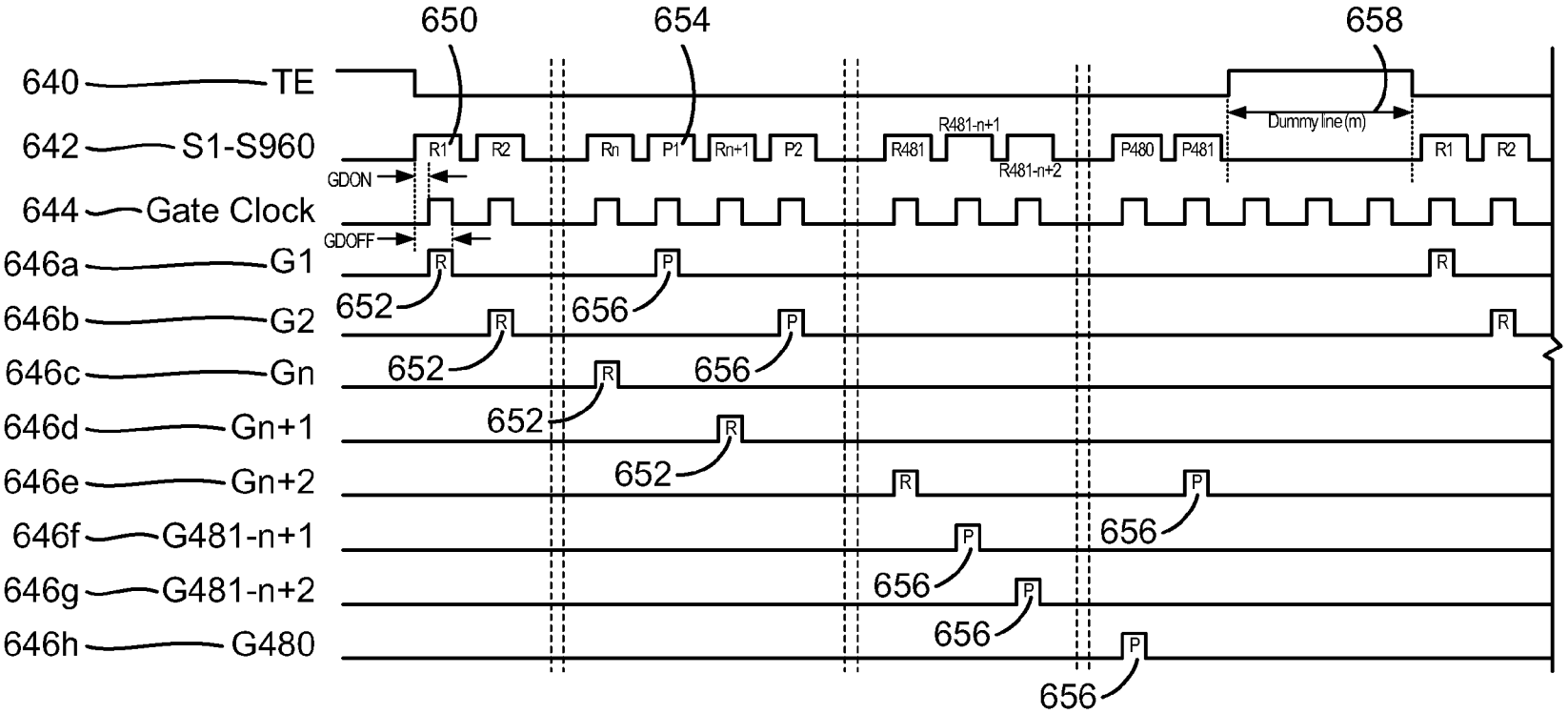
FIG. 14A is a timing diagram for row and column drive signals showing programming and non-programming times for the hybrid drive mode using a single pulse.

FIG. 14A is a timing diagram for row and column drive signals showing programming and non-programming times for the hybrid drive mode using a single pulse for the AMOLED display in FIG. 1. The diagram in FIG. 14A includes a tearing signal 640, a set of programming voltage select signals 642, a gate clock signal 644, and row strobe signals 646*a*-646*h*. The tearing signal 640 is strobed low to initiate the hybrid drive mode for a particular video frame. The programming voltage select signals 642 allow the selection of all of the pixels in a particular row for receiving programming voltages from the DAC 322 in FIG. 3. In this example, there are 960 pixels in each row. The programming voltage select signals 642 initially are selected to send a set of low grayscale range programming voltages 650 to the pixels of the first row.

When the gate clock signal 644 is set high, the strobe signal 646*a* for the first row produces a pulse 652 to select the row. The low gray scale pixels in that row are then driven by the programming voltages from the DAC 322 while the high grayscale pixels are driven to zero voltage. After a sub-frame time period, the programming voltage select signals 642 are selected to send a set of high grayscale range programming voltages 654 to the first row. When the gate clock signal 644 is set high, the strobe signal 646*a* for the first row produces a second pulse 656 to select the row. The high grayscale pixels in that row are then driven by the programming voltages from the DAC 322 while the low grayscale pixels are driven to zero voltage.

As is shown by FIG. 14A, this process is repeated for each of the rows via the row strobe signals 646*b*-646*g*. Each row is therefore strobed twice, once for programming the low grayscale pixels and once for programming the high grayscale values. When the first row is strobed the second time 656 for programming the high grayscale values, the first strobes for subsequent rows such as strobes 646*c*, 646*d* are initiated until the last row strobe (row 481) shown as strobe 646*e*. The subsequent rows then are strobed a second time in sequence as shown by the programming voltages 656 on the strobes 646*f*, 646*g*, 646*h* until the last row strobe (row 481) shown as strobe 646*e*.

Figure 14B:
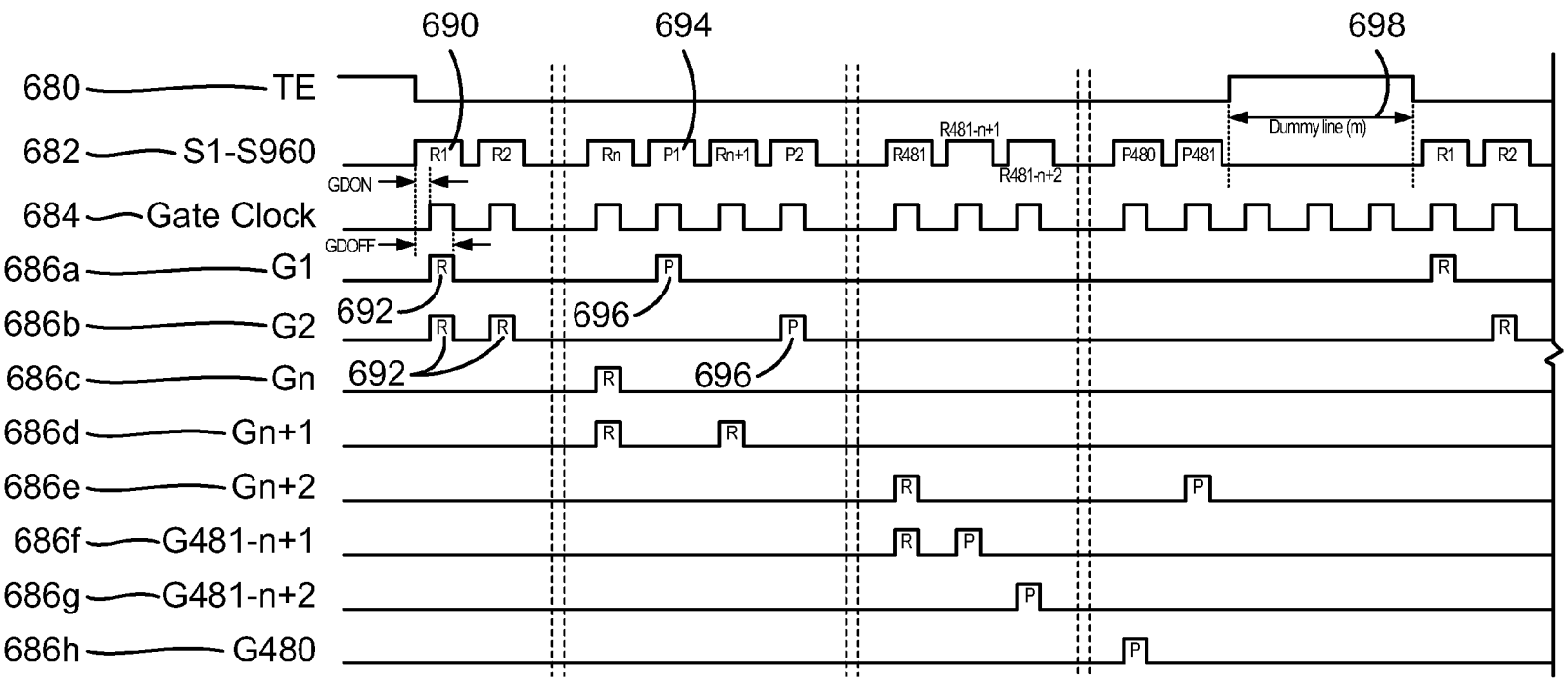
FIG. 14B is a timing diagram is a timing diagram for row and column drive signals showing programming and non-programming times for the hybrid drive mode using a double pulse.

FIG. 14B is a timing diagram for row and column drive signals showing programming and non-programming times for the hybrid drive mode using a double pulse. The double pulse to the drive circuit of the next row leaves the leakage path on for the drive transistor and helps improve compensation for the drive transistors. Similar to FIG. 14A, the diagram in FIG. 14B includes a tearing signal 680, a set of programming voltage select signals 682, a gate clock signal 684, and row strobe signals 686*a*-686*h*. The tearing signal 680 is strobed low to initiate the hybrid drive mode for a particular video frame. The programming voltage select signals 682 allow the selection of all of the pixels in a particular row for receiving programming voltages from the DAC 322 in FIG. 3. In this example, there are 960 pixels in each row. The programming voltage select signals 682 initially are selected to send a set of low grayscale range programming voltages 690 to the first row. When the gate clock signal 684 is set high, the strobe signal 686*a* for the first row produces a pulse 692 to select the row. The low gray scale pixels in that row are then driven by the programming voltages from the DAC 322 while the high grayscale pixels are driven to zero voltage. After a sub-frame time period, the programming voltage select signals 682 are selected to send a set of high grayscale range programming voltages 694 to the first row. When the gate clock signal 684 is set high, the strobe signal 686*a* for the first row produces a second pulse 696 to select the row. The high grayscale pixels in that row are then driven by the programming voltages from the DAC 322 while the low grayscale pixels are driven to zero voltage.

As is shown by FIG. 14B, this process is repeated for each of the rows via the row strobe signals 686*b*-686*h*. Each row is therefore strobed once for programming the low grayscale pixels and once for programming the high grayscale values. Each row is also strobed simultaneously with the previous row, such as the high strobe pulses 692 on the row strobe line 686*a* and 686*b*, in order to leave the leakage path on for the drive transistor. A dummy line that is strobed for the purpose of leaving the leakage path on for the drive transistor for the last active row (row 481) shown as strobe 646*e* in the display.

Figure 15:
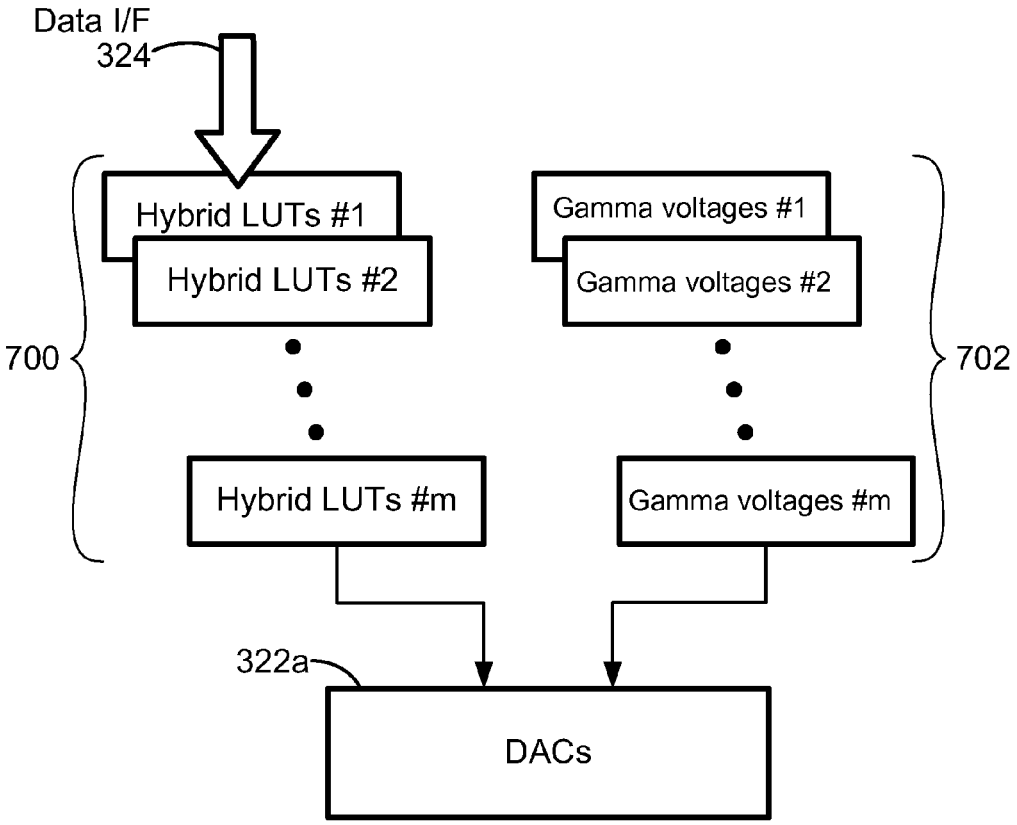
FIG. 15 is a diagram illustrating the use of multiple lookup tables and multiple gamma curves.

FIG. 15 illustrates a system implementation for accommodating multiple gamma curves for different applications and automatic brightness control, using the hybrid driving scheme. The automatic brightness control is feature where the controller 112 adjusts the overall luminance level of the display system 100 according to the level of ambient light detected by the light sensor 130 in FIG. 1. In this example, the display system 100 may have four levels of brightness: bright, normal, dim and dimmest. Of course any number of levels of brightness may be used.

In FIG. 15, a different set of voltages from LUTs 700 (#1-#n) is provided to a plurality of DAC decoders 322*a* in the source driver 110. The set of voltages is used to change the display peak brightness using the different sets of voltages 700. Multiple gamma LUTs 702 (#1-#m) are provided so that the DACs 322*a* can also change the voltages from the hybrid LUTs 700 to obtain a more solid gamma curve despite changing the peak brightness.

In this example, there are 18 conditions with corresponding 18 gamma curve LUTs stored in a memory of the gamma correction circuit 340 in FIG. 3. There are six gamma conditions (gamma 2.2 bright, gamma 2.2 normal, gamma 2.2 dim, gamma 1.0, gamma 1.8 and gamma 2.5) for each color (red, green and blue). Three gamma conditions, gamma 2.2 bright, gamma 2.2 normal and gamma 2.2 dim, are used according to the brightness level. In this example, the dim and dimmest brightness levels both use the gamma 2.2 dim condition. The other gamma conditions are used for application specific requirements. Each of the six gamma conditions for each color have their own gamma curve LUTs 702 in FIG. 13 which are accessed depending on the specific color pixel and the required gamma condition in accordance with the brightness control.

Figure 16A:
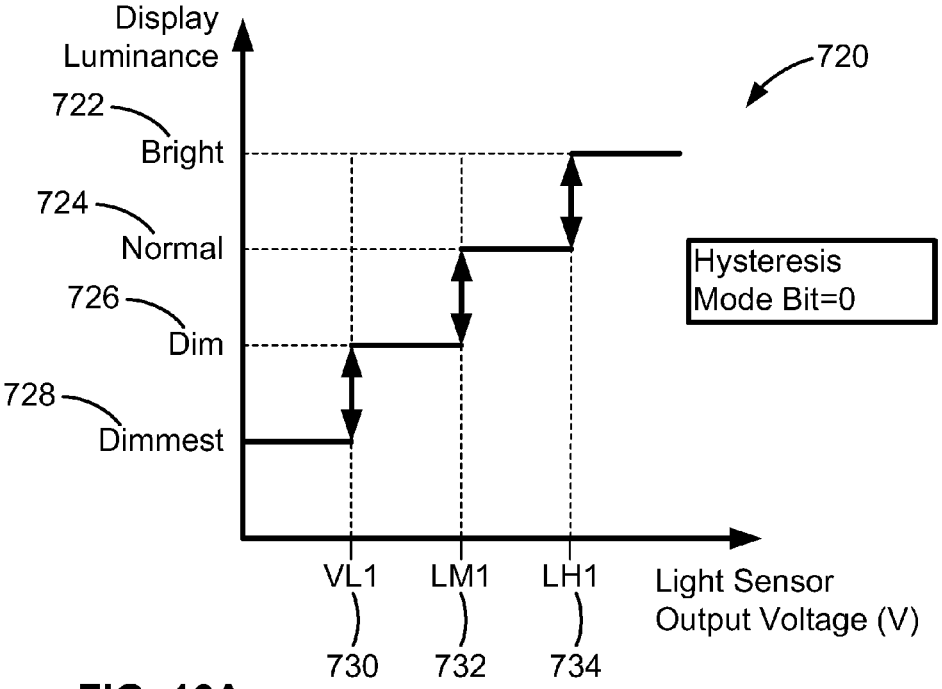
FIG. 16A is a luminance level graph of the AMOLED display in FIG. 1 for automatic brightness control without hysteresis.
Figure 16B:
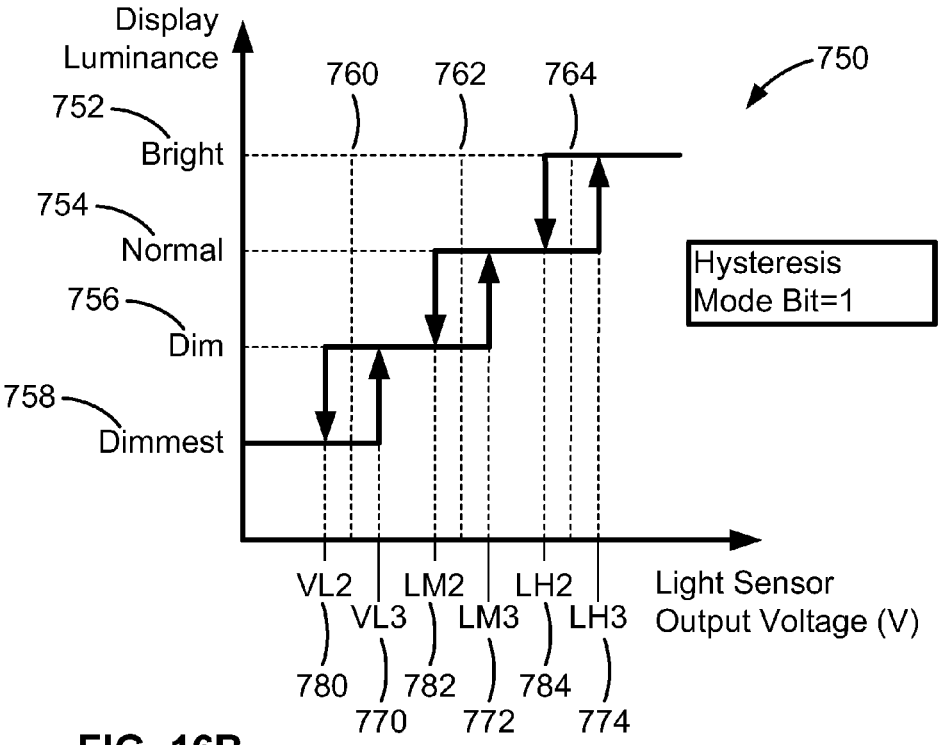
FIG. 16B is a luminance level graph of the AMOLED display in FIG. 1 for automatic brightness control with hysteresis.

FIGS. 16A and 16B show graphs of two modes of the brightness control that may be implemented by the controller 112. FIG. 16A shows the brightness control without hysteresis. The y-axis of the graph 720 shows the four levels of overall luminance of the display system 100. The luminance levels include a bright level 722, a normal level 724, a dim level 726 and a dimmest level 728. The x-axis of the graph 720 represents the output of the light sensor 130. Thus, as the output of the light sensor 130 in FIG. 1 increases past certain threshold levels, indicating greater levels of ambient light, the luminance of the display system 100 is increased. The x-axis shows a low level 730, a middle level 732 and a high level 734. When the detected output from the light sensor crosses one of the levels 730, 732 or 734, the luminance level is adjusted downward or upward to the next level using the LUTs 700 in FIG. 15. For example, when the ambient light detected exceeds the middle level 732, the luminance of the display is adjusted up to the normal level 724. If ambient light is reduced below the low level 730, the luminance of the display is adjusted down to the dimmest level 728.

FIG. 16B is a graph 750 showing the brightness control of the display system 100 in hysteresis mode. In order to allow smoother transitions to the eye, the brightness levels are sustained for a longer period when transitions are made between luminance levels. Similar to FIG. 16A, the y-axis of the graph 750 shows the four levels of overall luminance of the display system 100. The levels include a bright level 752, a normal level 754, a dim level 756 and a dimmest level 758. The x-axis of the graph 750 represents the output of the light sensor 130. Thus, as the output increases past certain threshold levels, indicating greater levels of ambient light, the luminance of the display system 100 is increased. The x-axis shows a low base level 760, a middle base level 762 and a high level 764. Each level 760, 762 and 764 includes a corresponding increase threshold level 770, 772 and 774 and a corresponding decrease threshold level 780, 782 and 784. Increases in luminance require greater ambient light than the base levels 760, 762 and 764. For example, when the ambient light detected exceeds an increase threshold level such as the threshold level 770, the luminance of the display is adjusted up to the dim level 756. Decreases in luminance require less ambient light than the base levels 760, 762 and 764. For example, if ambient light is reduced below the decrease threshold level 794, the luminance of the display is adjusted down to the normal level 754.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A method of using raw grayscale image data, representing images to be displayed in successive frames, to drive a display having pixels that include a drive transistor and an organic light emitting device, said method comprising:

defining high and low ranges of raw grayscale image data, and determining whether the raw grayscale image data for each pixel falls within said high range or said low range, converting said raw grayscale image to higher grayscale values that fall within said high range, responsive to said raw grayscale image data falling within said low range, driving said pixels with currents corresponding to said higher grayscale values during a first sub-frame time period that is shorter than a complete frame time period, responsive to said raw grayscale image data falling within said high range, driving said pixels with currents corresponding to said raw grayscale image data during a second sub-frame time period that is shorter than a complete frame time period and longer than the first sub-frame time period, and processing said raw grayscale image data by a smoothing function so as to avoid contorting effects by:

responsive to said raw grayscale image data falling within said low range, driving said pixels according to said smoothing function during said second sub-frame time period, and responsive to said raw grayscale image data falling within said high range, driving said pixels according to said smoothing function during said first sub-frame time period.

2. The method of claim 1 which includes making gamma corrections by adjusting both said higher grayscale values and said raw grayscale image data falling within said high range according to a preselected gamma curve before using them to drive said pixels.

3. The method of claim 2 which includes selecting said high and low ranges according to said preselected gamma curve used for said gamma corrections.

4. The method of claim 1 in which a lookup table is used to convert said raw grayscale image data that falls within said low range to said higher grayscale values.

5. The method of claim 1 in which said display is an AMOLED display.

6. The method of claim 1 in which said higher grayscale values contain an indicator that they have been converted from raw grayscale image data.

7. The method of claim 1 in which said gamma corrections of both said higher-grayscale values converted from raw grayscale image data falling within said low range, and said raw grayscale image values falling within said high range, are made according to the same gamma correction curve.

8. The method of claim 1, wherein said-pixels are organized in rows of pixels, the pixels in a row being simultaneously driven, and the time period of the first sub-frame does not overlap with the time period of the second sub-frame.

9. The method of claim 2, further comprising sensing ambient light around the display via an ambient light sensor, and adjusting the overall luminance of the display-based on the sensed level of ambient light.

10. The method of claim 9, wherein the adjusting the overall luminance is carried out by preselecting the gamma curve from a plurality of gamma curves, and the preselection is based on the sensed level of ambient light.

11. The method of claim 1, wherein a middle range of raw grayscale data is defined, the pixels with currents corresponding to said middle range of grayscale values being driven during a time period of the frame other than the time periods of the pixels with higher grayscale values.

12. An apparatus for using raw grayscale image data representing images to be displayed in successive frames, to drive a display having an array of pixels that each include a drive transistor and an organic light emitting device, multiple select lines coupled to said array for delivering signals that select when each pixel is to be driven, and multiple data lines for delivering drive signals to the selected pixels, said apparatus comprising:

a source driver coupled to said data lines and including a processing circuit for receiving said raw grayscale image data, determining whether the raw grayscale image data for each pixel falls within a preselected high range or a preselected low range, and converting said raw grayscale image data that falls within said low range to higher grayscale values that fall within said high range, and said source driver further includes:

a memory for storing said higher grayscale values corresponding to raw grayscale image data that falls within said low range, and raw grayscale image data that falls within said high range, a gamma correction circuit for retrieving the data stored in said memory and making gamma corrections to that data, a controller supplying control signals to said gamma correction circuit for controlling the timing of the retrieval of said data stored in said memory by said gamma correction circuit, and a digital-to-analog converter for converting gamma-corrected data from said gamma correction circuit to corresponding analog signals for driving said pixels, wherein said source driver is adapted to supply said pixels with currents corresponding to said higher grayscale values during a first sub-frame time period that is shorter than a complete frame time period responsive to said raw grayscale image data falling within said low range, to supply said pixels with currents corresponding to said raw grayscale image data during a second sub-frame time period that is shorter than a complete frame time period and longer than the first sub-frame time period responsive to said raw grayscale image data falling within said high range, and to process said raw grayscale image data by a smoothing function so as to avoid contorting effects by:

responsive to said raw grayscale image data falling within said low range, driving said pixels according to said smoothing function during said second sub-frame time period, and responsive to said raw grayscale image data falling within said high range, driving said pixels according to said smoothing function during said first sub-frame time period.

13. The apparatus of claim 12 in which said gamma correction circuit makes gamma corrections to both said higher grayscale values and said raw grayscale image data falling within said high range according to a preselected gamma curve before using them to drive said pixels.

14. The apparatus of claim 12 in which said gamma correction circuit is adapted to select said high and low ranges according to the gamma curve used for said gamma correction.

15. The apparatus of claim 12 in which said processing circuit includes a switch for selecting either a normal driving mode in which said pixels are driven with currents corresponding to said raw grayscale image data without converting any of the grayscale values to higher values, and a hybrid driving mode in which raw grayscale image data that falls within said low range is converted to higher grayscale values, and said pixels are driven with currents corresponding to said higher grayscale values during time periods that are shorter than a complete frame time period.

16. The apparatus of claim 12 in which said processing circuit includes a lookup table to convert said grayscale image data that falls within said low range to higher grayscale values.

17. The apparatus of claim 12 in which said display is an AMOLED display.

18. The apparatus of claim 12 in which said higher grayscale values contain an indicator that they have been converted from raw grayscale image data.

19. The apparatus of claim 12 in which said preselected time periods for image data converted from said high range are major portions of complete frame time periods, and said preselected time periods for image data converted from said low range are minor portions of complete frame time periods.

20. The apparatus of claim 12, further comprising an ambient light sensor sensing ambient light around the display, the ambient light sensor coupled to the controller, wherein the controller adjusts the overall luminance of the array pixels based on the level of sensed ambient light.

21. The apparatus of claim 20, wherein the controller selects one of a plurality of gamma curves based on the level of sensed ambient light, the selected one of the plurality of gamma curves being used by the gamma correction circuit to make the gamma corrections.

22. The apparatus of claim 12, wherein the processing circuit determines whether each pixel falls within a preselected middle range of raw grayscale data, the pixels with currents corresponding to said middle range of grayscale values being driven during a time period of the frame other than the time periods of the pixels with higher grayscale values.

* * * * *